US010684019B2

(12) United States Patent
Larsen

(10) Patent No.: US 10,684,019 B2
(45) Date of Patent: Jun. 16, 2020

(54) ELECTRIC WARMING ELEMENT FOR GAS BURNER

(71) Applicant: Whirlpool Corporation, Benton Harbor, MI (US)

(72) Inventor: Christopher A. Larsen, Ocoee, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 1228 days.

(21) Appl. No.: 14/943,090

(22) Filed: Nov. 17, 2015

(65) Prior Publication Data

US 2017/0138603 A1 May 18, 2017

(51) Int. Cl.

| | |
|---|---|
| ***F24C 1/02*** | (2006.01) |
| ***F24C 7/08*** | (2006.01) |
| ***F24C 3/12*** | (2006.01) |
| ***F24C 3/08*** | (2006.01) |

(52) U.S. Cl.

CPC ..... *F24C 1/02* (2013.01); *F24C 3/085* (2013.01); *F24C 3/122* (2013.01); *F24C 3/126* (2013.01); *F24C 7/082* (2013.01); *F24C 7/087* (2013.01)

(58) Field of Classification Search

CPC .. F24C 1/02; F24C 3/085; F24C 3/126; F24C 11/00; F23C 7/06; F23C 2700/04; F23N 2021/08; F23L 15/00; F23D 14/66; F23D 14/08; F23D 14/22; F23D 2900/14062

USPC .... 392/309, 308, 307; 126/39 BA, 40, 39 H, 126/39 N, 39 J, 39 K, 90 A, 41 R, 117; 431/11, 208; 219/443.1–468.2

See application file for complete search history.

(56) References Cited

U.S. PATENT DOCUMENTS

| | | | | |
|---|---|---|---|---|
| 2,463,712 A * | 3/1949 | Newell | F24C 3/128 126/39 G |
| 2,658,987 A | 11/1953 | Ogden | |
| 2,921,176 A | 1/1960 | Scofield | |
| 3,576,382 A * | 4/1971 | Finnstrand | F23D 11/44 431/208 |
| 4,899,723 A * | 2/1990 | Pajares | F24C 1/04 126/39 BA |
| 4,968,245 A * | 11/1990 | Ho | F23D 11/42 431/11 |
| 5,329,918 A | 7/1994 | Di Bari | |
| 6,222,163 B1 | 4/2001 | Arntz et al. | |
| 6,540,505 B1 * | 4/2003 | Wuest | F23D 11/406 431/207 |
| 6,877,503 B1 | 4/2005 | Hibshman, II et al. | |

(Continued)

FOREIGN PATENT DOCUMENTS

EP 2447606 A1 5/2012

*Primary Examiner* — Tu B Hoang
*Assistant Examiner* — Diallo I Duniver
(74) *Attorney, Agent, or Firm* — Price Heneveld LLP

(57) ABSTRACT

A burner assembly for a cooking hob includes a gas burner portion having a lower housing and a burner housing assembled with and supported by the lower housing. The burner housing defines a gas distribution path open at least on an outer surface of the burner housing through a plurality of outlets. A central region of the gas burner portion is defined by an opening within the burner housing and is at least partially enclosed beneath the gas burner portion by the lower housing. The burner assembly further includes a first electric heating element disposed beneath a portion of the lower housing within the central region of the gas burner portion.

19 Claims, 6 Drawing Sheets

(56) References Cited

U.S. PATENT DOCUMENTS

| | | | | |
|---|---|---|---|---|
| 7,800,023 | B2 | 9/2010 | Burtea et al. | |
| 8,563,901 | B2 | 10/2013 | Hitchcock et al. | |
| 2003/0085222 | A1 | 5/2003 | Erdmann | |
| 2007/0278319 | A1* | 12/2007 | Jenkins | F24C 3/128 236/15 A |
| 2008/0264406 | A1 | 10/2008 | Burtea et al. | |
| 2014/0048058 | A1 | 2/2014 | Donarski | |

* cited by examiner

ELECTRIC WARMING ELEMENT FOR GAS BURNER

BACKGROUND

The present device generally relates to a burner assembly for a cooking appliance. In particular, the burner assembly includes both a gas burner portion and an electric heating element.

Atmospheric gas burners for various cooking appliances, such as ovens, stand-alone cooktops and the like are typically able to operate within a range of about 10:1 from the high-end output to the low-end output thereof. For some generally larger variations of such burners with a maximum output in the range of about 18,000 BTU/hr, for example, a low-end operating range of about 1,800 BTU/hr may, thus be achievable. Such a range, however, may still be excessive for some cooking operations, such as simmering or working with "sensitive" foods. As one solution, so-called dual-crown burners have been developed that include a secondary, smaller gas burner nested within the larger burner. Such small gas burners are capable of providing a low operating range, but may be susceptible to being blown out by ambient air movement and may require complicated valves and/or plumbing for operation thereof.

SUMMARY

In at least one aspect of the present disclosure, a burner assembly for a cooking hob includes a gas burner portion having a lower housing and a burner housing assembled with and supported by the lower housing. The burner housing defines a gas distribution path open at least on an outer surface of the burner housing through a plurality of outlets. A central region of the gas burner portion is defined by an opening within the burner housing and is at least partially enclosed beneath the gas burner portion by the lower housing. The burner assembly further includes a first electric heating element disposed beneath a portion of the lower housing within the central region of the gas burner portion.

In at least another aspect, a cooking hob includes an upper support surface and a first burner assembly positioned along the upper support surface. The first burner assembly includes a gas burner portion having a lower housing and a burner housing assembled with and supported by the lower housing. The burner housing defines a gas distribution path open at least on an outer surface of the burner housing through a plurality of outlets. A central region of the gas burner portion is defined by an opening within the burner housing and is at least partially enclosed beneath the gas burner portion by the lower housing. A first electric heating element is disposed beneath a portion of the lower housing within the central region of the gas burner portion.

In at least another aspect, a cooking burner system includes a burner assembly having a gas burner portion with a housing defining a gas distribution path open at least on an outer surface of the gas burner portion through a plurality of outlets. An open central region of the gas burner portion is defined by and at least partially enclosed beneath a portion of the housing. The burner assembly further includes a first electric heating element disposed beneath the central region of the gas burner portion. The system further includes a gas supply line fluidically connected with the gas burner portion and including a valve defining a first output range for the gas burner portion and an electric power line connected with the first electric heating element and including a first switch defining on and off conditions for the first electric heating element.

These and other features, advantages, and objects of the present device will be further understood and appreciated by those skilled in the art upon studying the following specification, claims, and appended drawings.

DETAILED DESCRIPTION OF EMBODIMENTS

Figure 1:
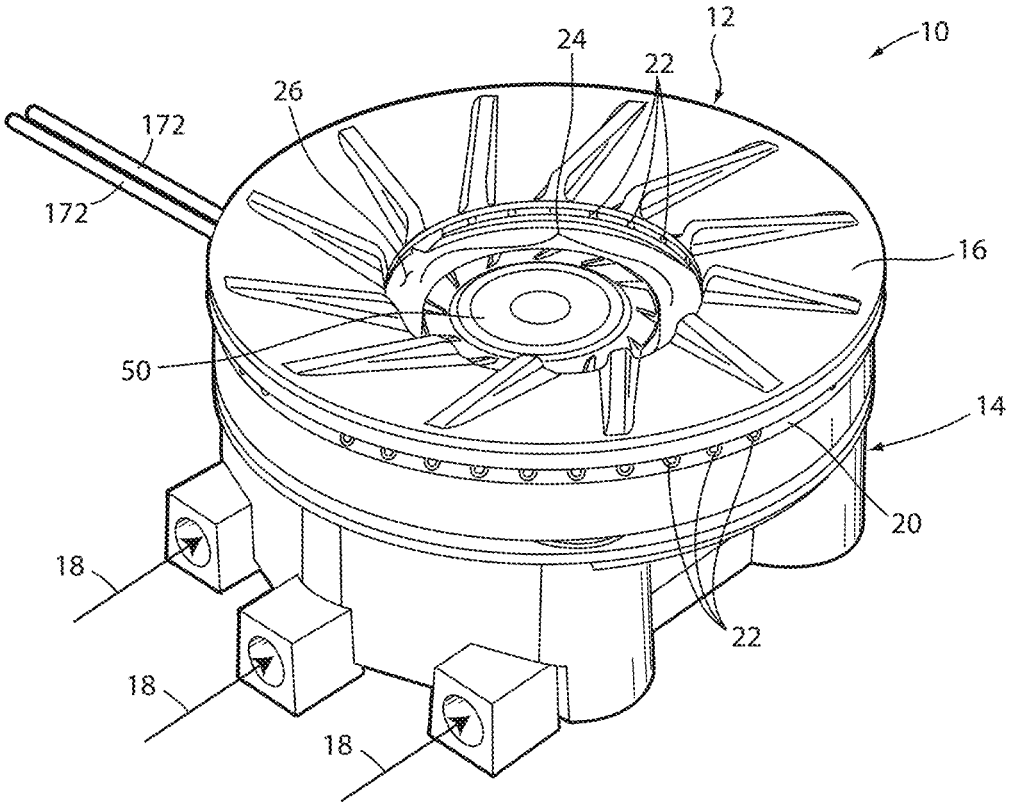
FIG. 1 is a perspective view of a burner assembly according to an aspect of the present disclosure.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
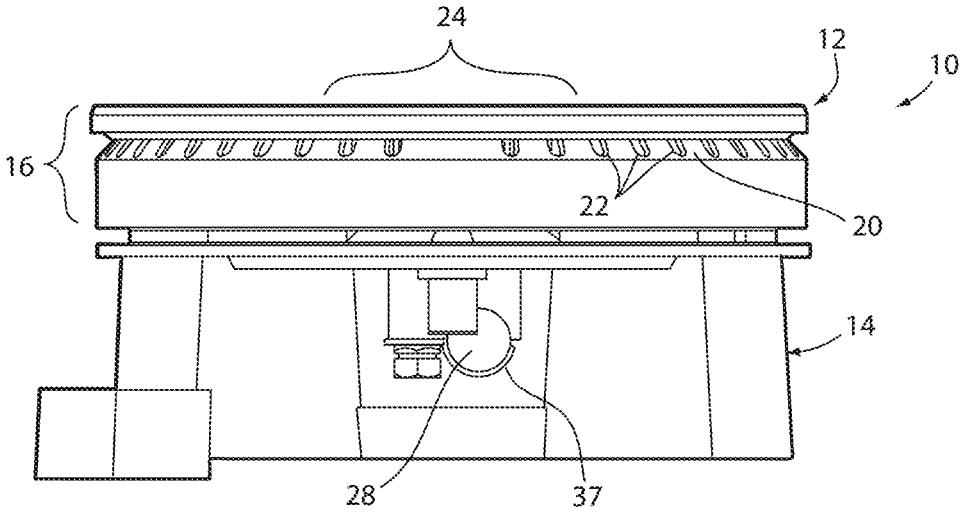
FIG. 2 is a side elevational view of the burner assembly of FIG. 1.

Referring to the embodiment illustrated in FIGS. 1 and 2, reference numeral 10 generally designates a burner assembly. The burner assembly 10 includes a gas burner portion 12 having a housing, which, as illustrated in FIG. 1, can include a lower housing 14 and a burner housing 16 assembled with and supported by the lower housing 14. The housing can define a gas distribution path 18 that opens to an outer surface 20 of the burner portion 12 through a plurality of outlets 22. A central region 24 of the burner assembly 10 is defined by an opening 26 within the housing, such as within burner housing 16 and at least partially enclosed beneath the gas burner portion 12 by the housing, such as by the portion of lower housing 14. A first electric heating element 28 is disposed beneath a portion of the housing, such as beneath lower housing 14, within the central region 24 of the gas burner portion 12.

In one embodiment, and as described further herein, the gas burner portion 12 can be configured to provide heat for cooking by burning fuel (e.g., natural gas, propane, and the like) supplied to outlets 22 through gas path 18. The particular heat output of gas burner portion 12 can be adjusted, as described further below, by controlling the flow rate of the fuel to be burned through gas path 18. In general, relatively larger burner assemblies 10 may be configured to reliably provide relatively high heating output, for example up to about 18,000 BTU/hr. However, such burners may, such as based on geometry and/or the particular number of outlets 22 included thereon, may have a low-end operation of, for example, about 1,800 BTU/hr. Such a rate of heating may be unacceptably high for use with sensitive food, or in low-simmer situations. Accordingly, electric heating element 28, as also discussed further below, can be operable to provide heat via an electric current at a predetermined amount, or in some embodiments, within a predetermined range that is lower than the low-end operation output of gas burner 12. In this manner, burner assembly 10 can provide for the above-described high output levels, which may be desirable to some cooking situations, while, further, providing low-end heating below the range provided by gas burner portion 12, via electric heating element 28. In one example, electric heating element 28 may provide about 150 watts of electric heating power, which may be equivalent to about 500 BTU/hr of gas burning heat.

Figure 3:
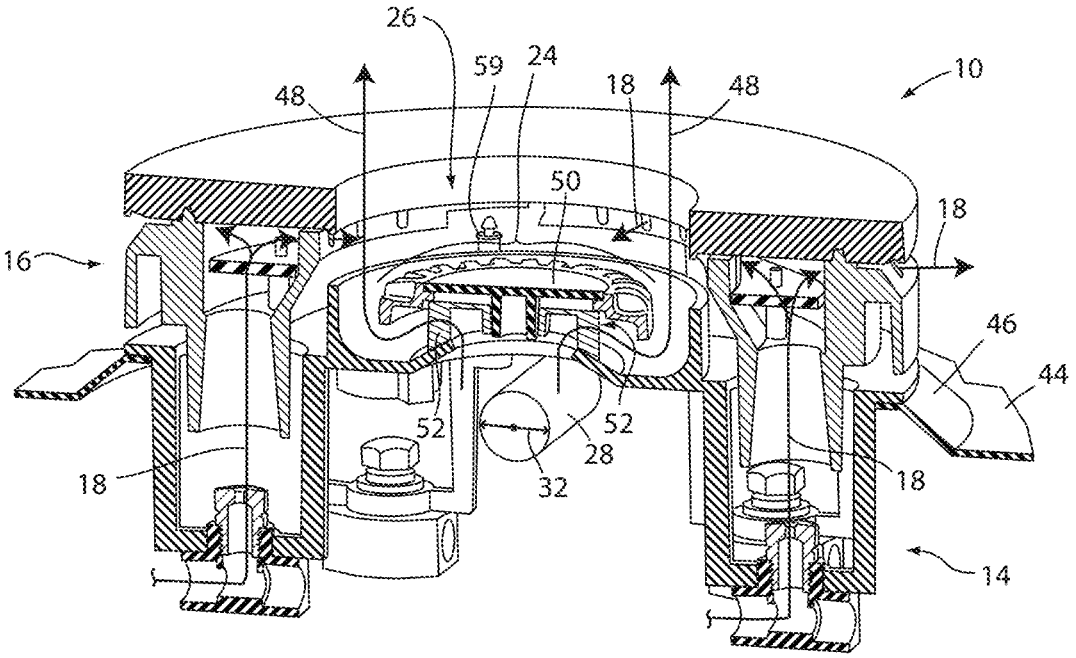
FIG. 3 is a perspective cross-sectional view of the burner assembly of FIG. 1.

As shown in FIGS. 2 and 3, electric heating element 28 can be supported beneath central region 24 of the gas burner portion 12 so as to provide heat therethrough, as described further below. As further shown in FIG. 2, electric heating element 28 can be supported beneath lower housing 14 of burner assembly 10 by an appropriately-positioned bracket 37 that can, for example, be removably affixable with lower housing 14, such as with mechanical fasteners, a snap-fit arrangement, or the like. Such positioning of electric heating element 28 beneath lower housing 14 can help to protect electric heating element 28 from damage and may prevent spilled food, liquids or the like from coming into contact therewith. Further, such positioning of electric heating element 28 can allow lower housing 14 to distribute the heat provided thereby across a generally larger area than that occupied by heating element 28 itself. In the example shown, such heat distribution can be provided by structuring lowering housing 14 to define at least one heated air flow path 48 therethrough within central region 24, such that heating element 28 can heat the surrounding ambient air causing such air to rise through lower housing 14 along heated airflow path 48 and upward toward a cooking article positioned over burner assembly 10.

As illustrated in FIG. 3, lower housing 14 can be configured with a shield 50 or other disc-shaped element such as a medallion or the like within central region 24 that can, along with adjacent portions of lower housing 14, define a plurality of air flow outlets 52 therethrough, which may direct respective portions of air flow path 48. In the arrangement shown herein, the air flow outlets 52 can be arranged beneath and around a portion of shield 50, such that shield 50 can serve to direct the air flow path 48 outwardly within central region 24. A corresponding adjacent portion of lower housing 14 may further serve to, subsequently, direct air flow path 48 upwardly through opening 26 in burner housing 16. Such an arrangement can serve to spread out the flow of heat generated by heating element 28, which may provide more even heating of a cooking article positioned over burner assembly 10.

In an embodiment, electric heating element 28 can be of a construction generally similar to that of a known electric heating elements, such as those provided in connection with electric ovens and/or burners. In such a construction, heating element 28 can include a conductive material sufficient to carry an electrical current therethrough, but having a high resistive value, so as to generate a desired heat output upon being subjected to a current. Heating element 28 can further include various additional layers or coatings in a manner similar to various known electric heating elements for cooking applications. In addition to material selection, heating element 28 can further be configured with an appropriate size, including diameter 32 and length 34 (such as length 134, as depicted the schematic view of FIG. 8), according to known parameters. As depicted, electric heating element 28 may be in the form of an elongate extruded profile, including that of a circle, which may give heating element 28 a generally cylindrical shape. Other profiles for electric heating element 28 are possible, as are other general shapes thereof, examples of which are discussed further herein.

Figure 4:
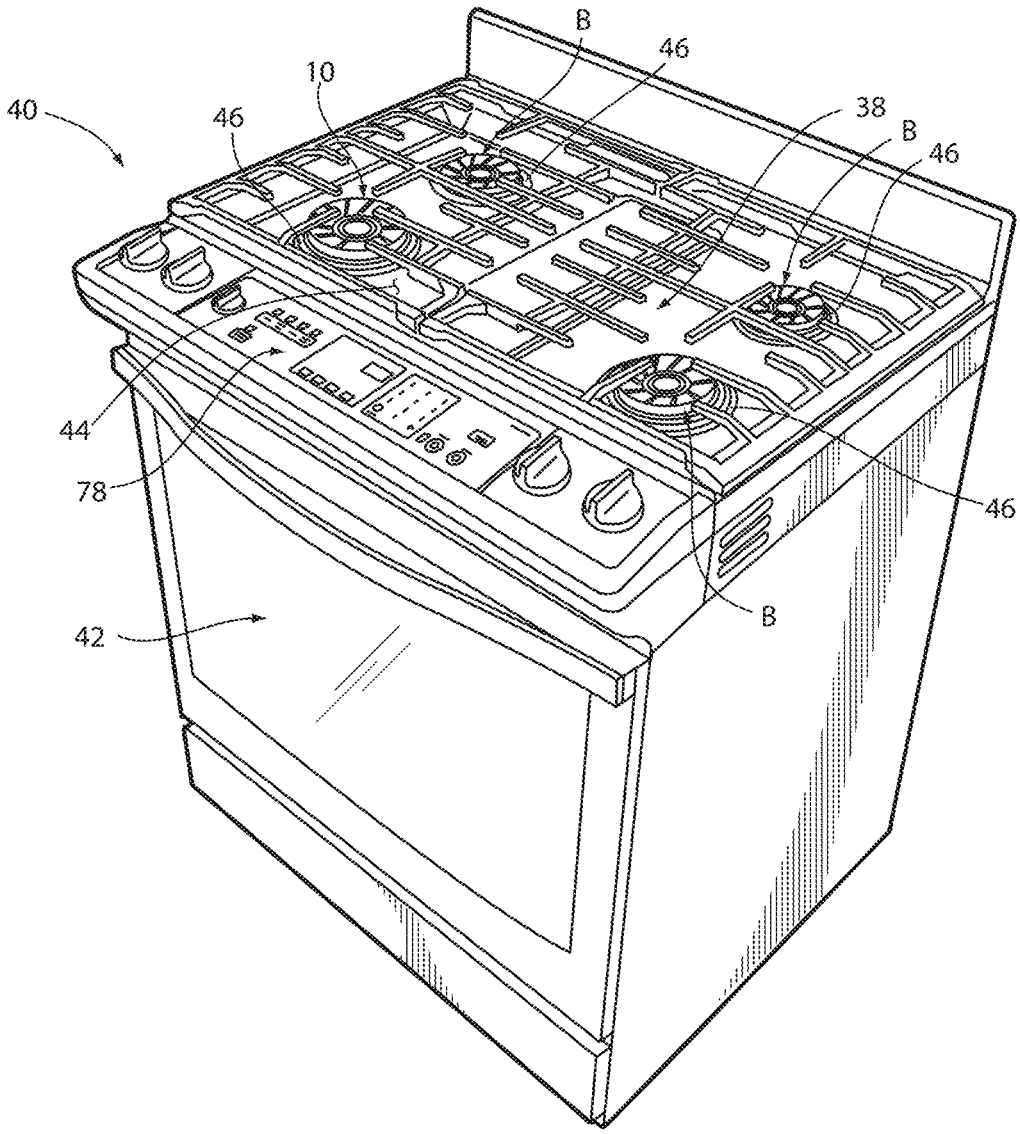
FIG. 4 is a perspective view of a cooking appliance including at least one of the burner assembly of FIG. 1.

As shown in FIG. 4, a burner assembly 10 of the type shown and described with respect to FIGS. 1-3 above, may be used in connection with a cooking hob 38. Such a cooking hob 38 may be included in a stand-alone cooktop or in connection with a range 40 including cooking hob 38 and an oven 42 in a single unit, as depicted in FIG. 4. Regardless of the specific type of appliance in which cooking hob 38 is included, cooking hob 38 may generally include a support surface 44 defining a number of burner locations 46 on which a number of burners may be assembled. Such burners may be in fluidic communication with a fuel source within cooking hob 38 such that the flow of fuel to the individual burners may be independently controllable. Such burners may be of varying sizes to provide for various cooking locations along cooking hob with various heat outputs. In one embodiment a single burner 10 may be of the type described herein including an electric heating element 28 disposed beneath a lower housing 14 thereof within a central region 24. In other embodiments, additional ones of the depicted burners may also be a burner assembly 10, as described above. Further, such burner assemblies 10 may be used in connection with various other types of cooking hobs providing different arrangements of burner locations 46 and, accordingly, burner assemblies 10.

Figure 5:
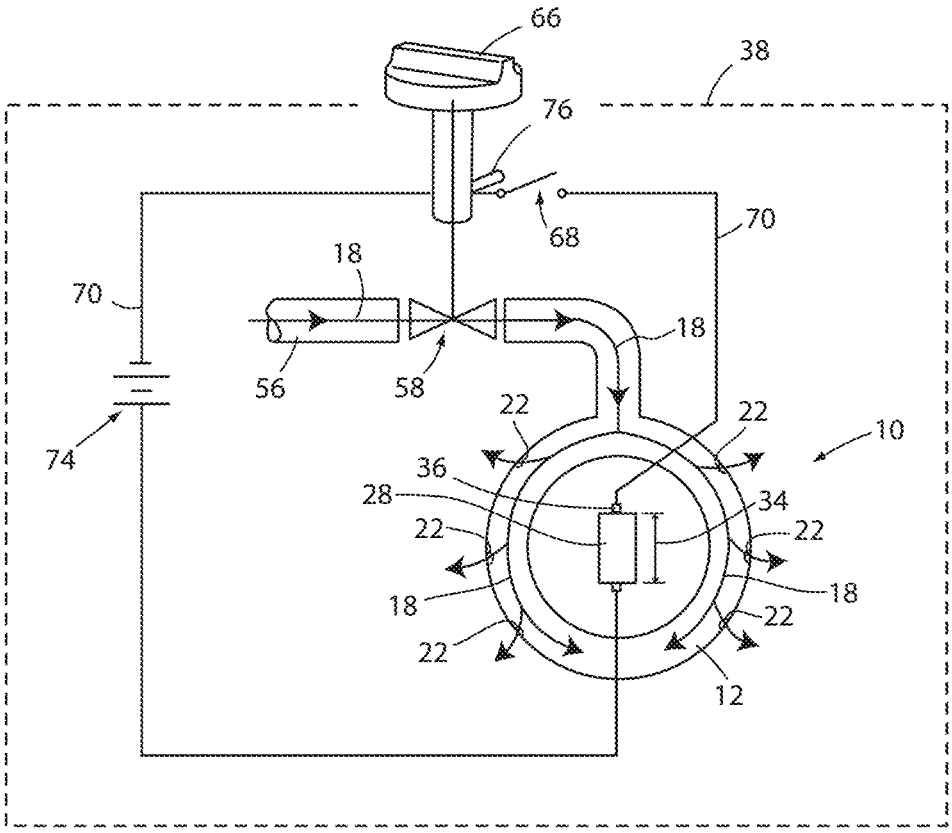
FIG. 5 is a schematic view of various components of a cooking hob for controlling operation of a burner assembly according to FIG. 1.

Turning now to FIG. 5, a schematic view of the portion of cooking hob 38 is shown, including various structures and features for controlling the operation of burner assembly 10. As discussed above, such features may provide fuel to be burned by gas burner portion 12 and electricity to be used by electric heating element 28 in generating heat. In particular, cooking hob 38 includes a first gas line 56, including at least a portion of which is in fluidic communication with gas burner portion 12, such as by appropriate connection with lower housing 14. In an embodiment, such as that which is shown in FIG. 4, wherein cooking hob 38 includes a plurality of burners B, at least some of which may be gas-burning burners, fuel line 56 may include a plurality of branches respectively fluidically coupled with such burners B. As further shown in FIG. 5, fuel line 56 may include a valve 58 for controlling the particular flow rate of fuel along gas distribution path 18 to be consumed by gas burner portion 12 (other branches of fuel line 56 in communication with other burners B including similar valves, controls, and the like). Valve 58 may be adjustable within the predetermined range of fuel consumption for gas burner portion 12, such as discussed above and may, further, be configured to provide a position in which gas distribution path 18 is interrupted so as to prevent fuel flow to burner portion 12 in an "off" condition for burner portion 12.

As further shown in FIG. 5, an electric supply line 70 may be coupled with electric heating element 28, such as by coupling with any connections 36 exposed thereon, or by other such means. Electric supply line 70 may include one or more wire segments, along with various types of electronic circuitry, as may be desired to provide electricity to electric heating element 28. Further, electric supply line 70 may be electrically connected with a power source 74, such as by connection of cooking hob 38 within an appropriately configured wall outlet, or the like. Power source 74 may, further, include circuitry to alter the characteristics of the power provided by such a wall outlet, as may be desired depending on the particular characteristics of electric heating element 28.

As discussed, cooking hob 38 may be configured to operate electric heating element 28 at a single, predetermined output level (given acceptable tolerances) that may be predetermined based on the characteristics of power supply 74 and/or of electric heating element 28. In such an embodiment, a switch 68 may be provided within electric supply line 70. Switch 68 may be closeable to permit an electric current to flow to the first electric heating element 28 and openable to interrupt such current so that electric heating element 28 is in an off condition. As illustrated, a single control element, shown in the form of a knob 66, can be included with cooking hob to control operation of valve 58 within the desired range, as well as to selectively open and close switch 68 to alternately activate and deactivate electric heating element 28, as desired. In a further embodiment, the flow of fuel along gas distribution path 18 through valve 58, as well as the activation of electric heating element 28 by operation of switch 68 may be implemented by a digital control, including one or more printed circuit boards coupled with or including switch 68 and coupled with a motor associated with valve 58 to control operation thereof. Control of such a digital control system may be implemented by a digital input pad 78 as depicted in FIG. 4.

As discussed above, in one embodiment, cooking hob 38 may be configured to operate gas burner portion 12 within a predetermined range such as that which may be established based on the geometry and/or outlet 22 configuration of gas burner portion 12. Further, cooking hob 38 may operate electric element 28 at a predetermined output level below a low end of the operating range of the gas burner portion 12. In particular, the control element within cooking hob 38 and associated with burner assembly 10 may be configured to implement such a control scheme for burner assembly 10 and to allow user control thereof. In the example depicted in FIG. 5, the control element may include a knob 66 that may be operably coupled with valve 58 such that turning of knob 66 in a predetermined direction may open valve 58 from a closed position and through a desired range of operation to an upper limit thereof. Knob 66 may further be configured to activate an ignitor 59, such as that which is depicted in FIG. 3, at least when knob 66 is in a predetermined position within the operating range thereof.

In one example, valve 58 may be configured such that a closed position thereof is adjacent the upper end of the operating range of burner portion 12, such that when knob 66 is initially turned, the flow of fuel along gas distribution path 18 through valve 58 is at a high end of the range provided thereby and, further, such that ignitor 59 is activated. In such a configuration, as knob 66 is continued to be turned in the same direction, valve 58 may close, thereby reducing the flow of fuel through gas distribution path 18 and lowering the corresponding heat output of gas burner portion 12. If such rotation is further continued, valve 58 may reach a low-end of operation corresponding to that of gas burner portion 12, at which time valve 58 may be configured to, close again, thereby cutting off the flow of fuel along gas distribution path 18. Simultaneously with such closing of valve 58, an arm 76 or other such feature coupled with knob 66 may engage with switch 68 so as to activate electric heating element 28 at the predetermined output level. In such an arrangement, the turning of knob 66 in a reverse direction disengages arm 76 from switch 68, thereby deactivating electric heating element 28, at which point a flow of fuel along gas distribution path 18, through valve 58, may be re-established and may be re-ignited by subsequent activation of ignitor 59. Further, in such operation, knob 66 may be manipulated within the range of operation of gas burner portion 12 to adjust a particular heat output thereof within the predetermined range. An inverse operating scheme may also be provided wherein initial rotation of knob 66 activates electric heating element 28 and continued rotation of knob 66 causes ignition of gas burner portion 12 at a low end output which may be increased by still further rotation of knob 66.

Figure 6:
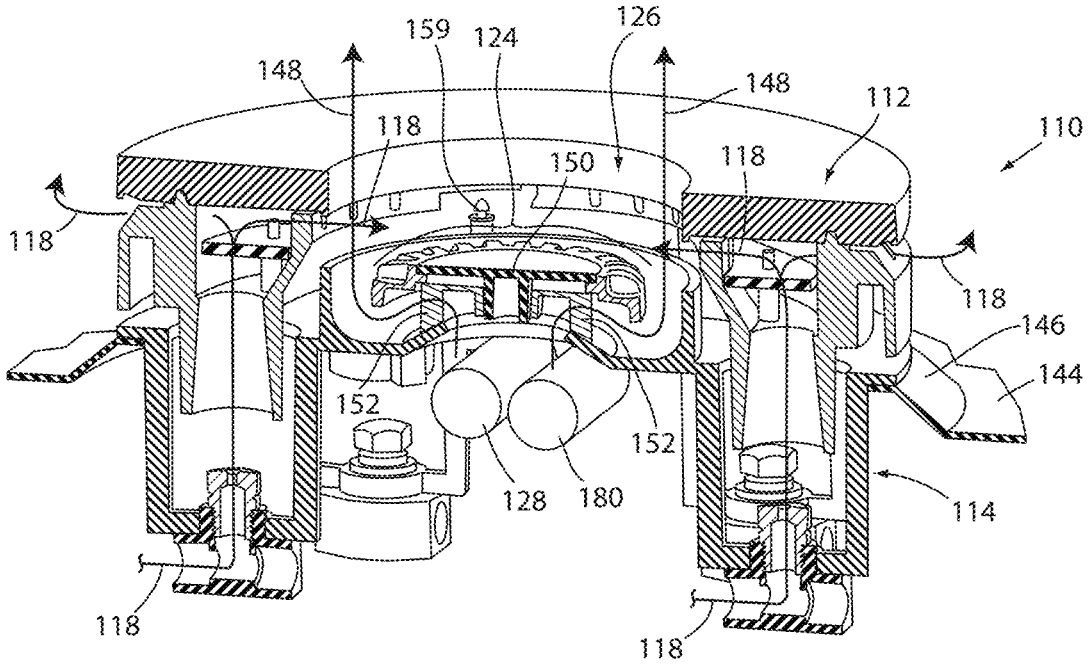
FIG. 6 is a perspective cross-section view of an alternative burner assembly according to another aspect of the disclosure.

Turning now to FIG. 6, a further embodiment of a burner assembly 110 is shown, that is generally similar to the burner assembly 10 (with similar features indicated by similar numbers increased by 100), in which first and second electric heating elements 128 and 180 are positioned adjacent to one another beneath central portion 124 of lower housing 114. Such an arrangement may be useable in a manner similar to that which is described above with respect to FIGS. 1-5, in which electric heating elements 128 and 180 may be used to provide a low-end range of operation for burner assembly 10 beneath a lower limit of the operating range of gas burner portion 112. Further, by providing two electric heating elements 128 and 180 the low-end heat output provided thereby can be varied by activation of both electric heating elements 128 and 180 together or by activation of only a single one of electric heating elements, such as electric heating element 128. Such operation is depicted graphically in FIG. 7, in which gas burner portion 112 is operable within a first range 160 to provide an output 161 that varies within such a range from a maximum output level $T_{max}$ to a lower output level corresponding to a low end of range 160. Such operation may be considered a regular operating range, wherein cooking hob 38 operates burner assembly 10 as a regular gas-powered burner.

As further illustrated, below the operating range 160 of gas burner portion 112, an operating range 162 may be provided in which a single electric heating element 128 is activated alone to operate at an output level 164 that is illustrated as being beneath the output 161 of the gas burner portion 112, including at the low end thereof (this scheme may be representative of the operation of burner assembly 10, as described above). In one example, each electric heating element 128 and 180 may be configured to operate with an output of about 150 watts, such that output level 164 within operating range 162 is about 150 watts. Further, between operating ranges 162 and 160, a third operating range 188 may be provided in which both electric heating elements 128 and 180 are activated such that they together provide an output level 190 that is above output level 164. In an embodiment, both electric heating elements 128 and 180 may be configured with to provide an output of about 150 watts, leading output level 190 to be about equal to about 300 watts. Other configurations are possible, in which electric heating elements 128 and 180 are configured to provide other output levels which may or may not be the same.

Figure 8:
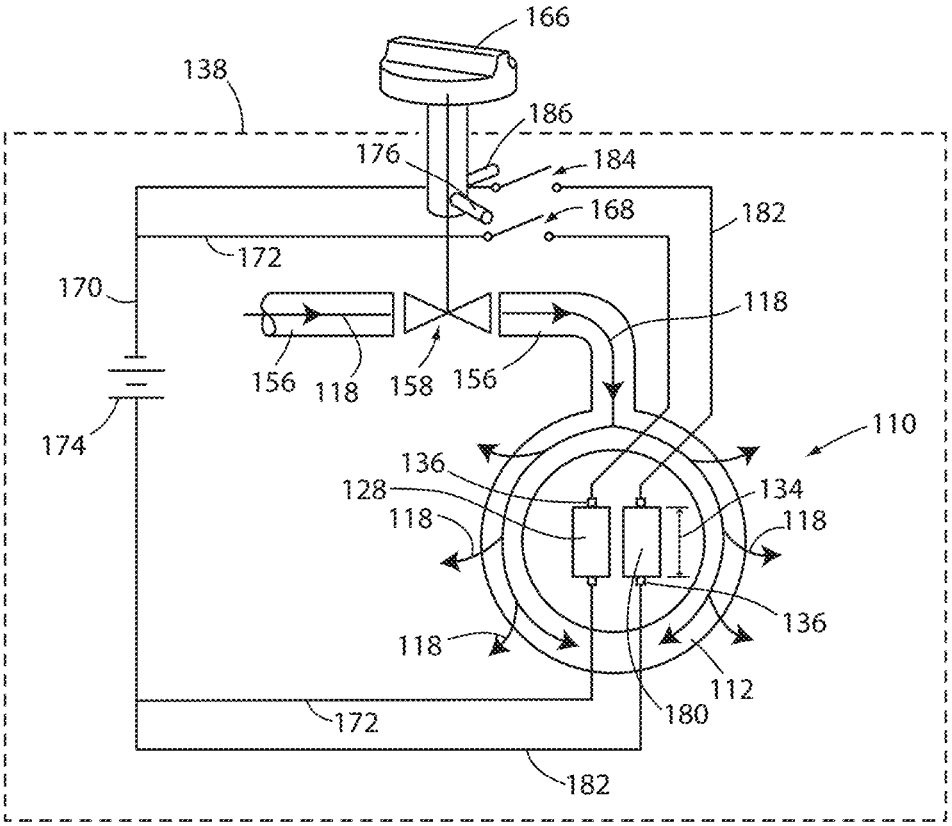
FIG. 8 is a schematic view of various components of a cooking hob for controlling operation of a burner assembly according to FIG. 6.

FIG. 8 schematically depicts a portion of a cooking hob 138 that may be similar to the cooking hob 38 described above with respect to FIG. 4, including the various internal components for providing fuel and electricity to burner assembly 110 and control of the operation of the operation of burner assembly 110. In a manner similar to that which is described above in FIG. 5, a gas supply line 156, which may include an individual branch thereof (other branches of fuel line 156 connecting with other burner assemblies B) may be fluidically coupled with gas burner portion 112 of burner assembly 110 to provide a flow of fuel thereto within the desired operating range. The flow of fuel along gas distribution path 118 through fuel line 156 may be controlled by a valve 158 to provide one or more off positions for gas burner portion 112 as well as control of the flow rate of fuel along gas distribution path 118 within the desired operating range.

Electric supply line 170 may be coupled with a power source 174 and may, further, connect separately with electric heating elements 128 and 180 by respective branches 172 and 182 of electric supply line 170. Each such supply line branch 172 and 182 may include a respective switch 168 and 184 for selectively turning the respective electric heating elements 128 and 180 on or off. A control element in the form of a knob 166 can be provided in connection with burner assembly 110 such that turning thereof can control the operation of valve 158 to provide a desired flow of fuel to gas burner portion 112, as well as to control operation of ignitor 159 in a manner similar to that which is described above. Further, knob 166 can include a first control arm 176 or other similar structure positioned to cause opening and closing of switch 168 to activate and de-activate electric heating element 128, as well as a second arm 186 or similar structure to selectively operate switch 184 to further control operation of second electric heating element 180.

Figure 7:
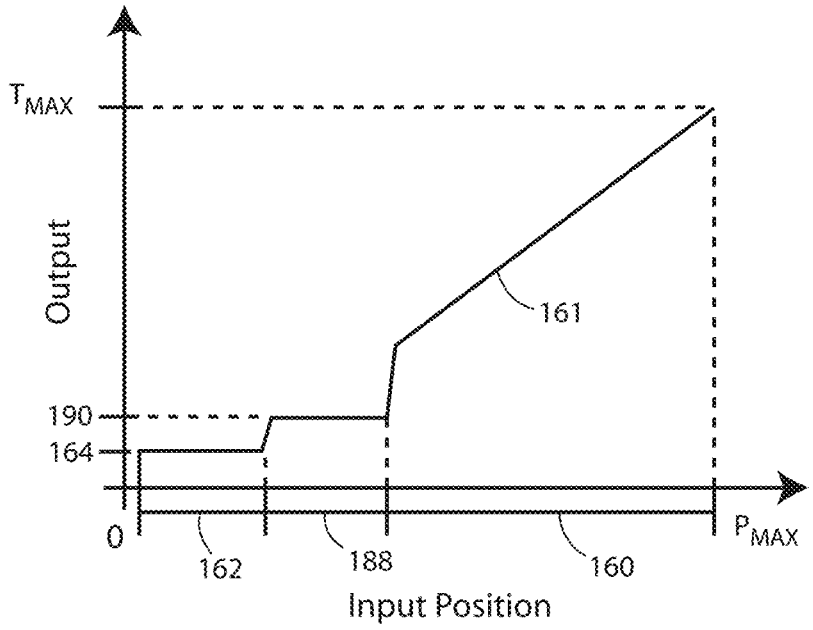
FIG. 7 is a graph showing various output ranges of the burner assembly of FIG. 6 according to one control scheme useable therewith.

In an embodiment knob 166, including arms 176 and 186 can be configured to implement the operating scheme described above with respect to FIG. 7, in which a first low end operating range of burner assembly 110 can be implemented by activation of first electric heating element 28, and a second operating range above the first low-end operating range can be implemented by activating second electric heating element 180, while continuing to maintain first electric heating 128 in an on position. Further, as described above, a third operating range can be provided in which first and second heating elements 128 and 180 are deactivated and gas burner portion 112 is ignited and is adjustable within the provided operating range thereof. Knob 166 can be configured in its operative connection with valve 158, as well as arms 176 and 186 to initially implement operation within range 162, followed by range 188 and subsequently range 160 with the output 161 increasing to $T_{max}$, as illustrated in FIG. 7. Conversely, initial operation of knob 166 can provide operation of gas burner portion 112 within range 160 followed by operation of first and second electric heating elements 128 and 180 within range 188, and operation of first electric heating element 128 within operating range 162.

Figure 9:
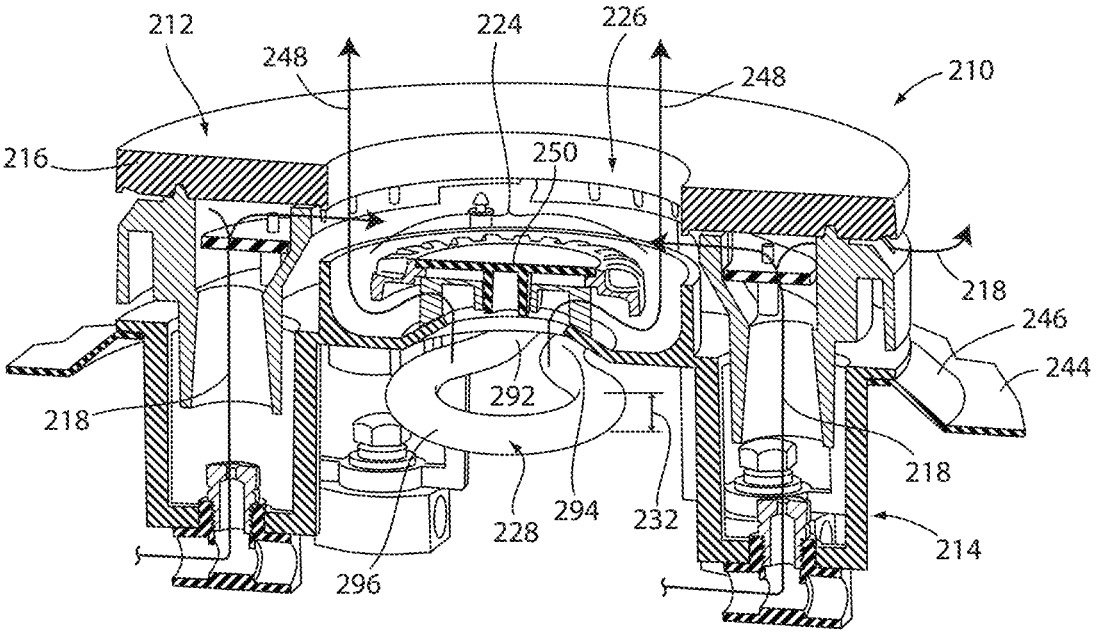
FIG. 9 is a perspective cross-section view of an alternative burner assembly according to another aspect of the disclosure.

Turning now to FIG. 9 a further embodiment of a burner assembly 210 is depicted, in which the structure and operation thereof may be generally similar that which is described above with respect to FIGS. 1-5 (with similar features indicated by similar numbers increased by 200), but in which electric heating element 228 is configured in a loop or annular shape. As illustrated, such a heating element 228 extends between two adjacent first and second ends 292 and 294 along a loop portion 296 that may be generally circular in shape so as to encircle central region 224 beneath lower housing 214. Lower housing 214 may be similarly configured with a shield 250 covering a plurality of annularly arranged air flow outlets 252 that may direct air flow paths 248 upward through lower housing 214 and outwardly within central area 224 and upward through opening 220 in burner housing 216. Electric heating element 228 may be configured with a size, including with the size of the loop portion 296, as well as the diameter 232 thereof to provide a desired heat output, including at a predetermined level or within an adjustable range in a manner similar to that which is employed by other electric heating elements such as electric burners or the like. In a further embodiment, a similar electric heating element may define a spiral, or coil, shape similar to an electric cooktop burner. Burner assembly 210 may be included in a cooking hob similar to cooking hob 38 depicted in FIG. 4 and may be operated in a manner similar to that which is described above with respect to FIG. 5, such as by inclusion of burner assembly 210 in an arrangement similar to that which is depicted in FIG. 5.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A burner assembly for a cooking hob, comprising:

a gas burner portion, including a lower housing and a burner housing assembled with and supported by the lower housing, the burner housing defining a gas distribution path open at least on an outer surface of the burner housing through a plurality of outlets, a central region of the gas burner portion being defined, in part, by an opening of the burner housing, being externally exposed to an exterior of the gas burner portion, and being at least partially enclosed by a shield supported by the lower housing, disposed within the central region, and defining at least one heated air flow path passing beneath the shield into, and through, the central region; and a first electric heating element disposed external to the lower housing and beneath the shield.

2. The burner assembly of claim 1, wherein the lower housing further defines the at least one heated air flow path therethrough within the central region and adjacent to the shield.

3. The burner assembly of claim 2, wherein the at least one heated air flow path through the lower housing within the central region includes a plurality of heated air flow outlets at least partially defined by the shield.

4. The burner assembly of claim 1, wherein:

the gas burner portion is operable within a first output range with a lower limit; and the electric heating element is operable within a second range with an upper limit that is lower than the lower limit of the first output range.

5. The burner assembly of claim 4, wherein:

the lower limit of the gas burner portion is 1800 BTU/hr; and the upper limit of the electric heating element is equal to 150 watts.

6. The burner assembly of claim 1, wherein the first electric heating element defines an elongate extruded shape.

7. The burner assembly of claim 1, wherein the first electric heating element is in one of an annular or spiral shape.

8. A cooking hob, comprising:

an upper support surface; and a first burner assembly, including:

a gas burner portion, including a lower housing and a burner housing assembled with and supported by the lower housing, the burner housing defining a gas distribution path open at least on an outer surface of the burner housing through a plurality of outlets, a central region of the gas burner portion being defined by an opening of the burner housing that externally exposes the central region to an exterior of the gas burner portion, the central region being at least partially enclosed by a shield supported by the lower housing and disposed within the central region; and a first electric heating element disposed beneath the shield.

9. The cooking hob of claim 8, wherein the cooking hob includes a first gas line in communication with the gas distribution path of the gas burner portion and including a valve operable to define an operating range for the gas burner portion having a lower limit.

10. The cooking hob of claim 9, wherein the cooking hob further includes an electric power line connected with the first electric heating element and configured for operating the first electric heating element at an output level below the lower limit of the gas burner portion.

11. The cooking hob of claim 10, further including a knob operably coupled with the valve and with a switch positioned within the electric power line, the control knob defining a low operating range wherein the switch is operable to provide power to the first electric heating element and a regular operating range in which the switch interrupts power to the electric heating element and controls an output level of the gas burner portion within the first output range.

12. The cooking hob of claim 8, wherein the burner assembly further includes a second electric heating element adjacent the first electric heating element, the cooking hob further including:

an electric power line connected with the first heating element and the second heating element;

a first switch within the electric power line and operable for alternately permitting and interrupting an electric current from flowing to the first electric heating element; and a second switch within the electric power line and operable for alternately allowing and preventing the electric current from flowing to the second electric heating element.

13. The cooking hob of claim 12, further including a control element coupled with the first switch and the second switch and operable within a first range and a second range;

wherein when in the first range, the control element causes the first switch to allow the electric current to flow to the first electric heating element and the second switch to prevent the electric current from flowing to the second electric heating element; and wherein when in the second range, the input device causes the first and second switches to respectively allow the electric current to flow to the first and second electric heating elements.

14. The cooking hob of claim 8, further including a control element, wherein the control element is a rotatable knob.

15. The cooking hob of claim 8, further including a control element wherein the control element is a digital input pad.

16. A cooking burner system, comprising:

a burner assembly, including:

a gas burner portion, including a housing defining a gas distribution path open at least on an outer surface of the gas burner portion through a plurality of outlets, an open central region of the gas burner portion being defined by and at least partially enclosed beneath a portion of the housing, the open central region defining at least one heated air flow path, the housing further including a shield disposed within the open central region, and the at least one heated air flow path passing from beneath the shield, into, and out of the open central region external to the gas burner portion; and a first electric heating element external to the housing and disposed beneath the shield;

a gas supply line fluidically connected with the gas burner portion and including a valve defining a first output range for the gas burner portion; and an electric power line connected with the first electric heating element and including a first switch defining on and off conditions for the first electric heating element.

17. The system of claim 16, further comprising a control element coupled with the valve and the first switch for controlling operation thereof within a low operating range wherein the switch is operable to provide power to the first electric heating element and a regular operating range in which the switch interrupts power to the electric heating element and controls an output level of the gas burner portion within the first output range.

18. The system of claim 17, wherein the control element is one of a knob and a digital input pad.

19. The system of claim 16, wherein:

the burner assembly further includes a second electric heating element adjacent the first electric heating element, the electric power line being further connected with the second electric heating element; and the electric power line further includes a second switch defining on and off conditions for the second electric heating element.

* * * * *